US009449504B2

(12) United States Patent
Yee et al.

(10) Patent No.: US 9,449,504 B2
(45) Date of Patent: Sep. 20, 2016

(54) CODE SEQUENCE CONTROL OF INFRARED BLASTER

(71) Applicant: MICROSOFT TECHNOLOGY LICENSING, LLC, Redmond, WA (US)

(72) Inventors: Dawson Yee, Medina, WA (US); Leslie Larsen, Seattle, WA (US); Matthew D. Morris, Seattle, WA (US); Sean S. Chiu, Redmond, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 181 days.

(21) Appl. No.: 13/848,534

(22) Filed: Mar. 21, 2013

(65) Prior Publication Data

US 2014/0286641 A1 Sep. 25, 2014

(51) Int. Cl.
*G08C 23/04* (2006.01)

(52) U.S. Cl.
CPC ..... *G08C 23/04* (2013.01)

(58) Field of Classification Search
CPC ..... G08C 23/04
USPC ..... 398/107
See application file for complete search history.

(56) References Cited

U.S. PATENT DOCUMENTS

| | | | | |
|---|---|---|---|---|
| 4,307,388 | A | 12/1981 | Doenges et al. | |
| 5,424,718 | A | 6/1995 | Muller et al. | |
| 6,753,786 | B1 | 6/2004 | Apperson et al. | |
| 6,769,129 | B1 * | 7/2004 | Perlman | H04N 5/4403 348/734 |
| 6,828,733 | B1 * | 12/2004 | Crenshaw | H02J 9/02 315/150 |
| 2001/0010503 | A1 * | 8/2001 | Darbee | G08C 19/28 341/176 |
| 2002/0171544 | A1 | 11/2002 | Schmurr | |
| 2003/0167171 | A1 * | 9/2003 | Calderone | 704/270 |
| 2005/0127298 | A1 | 6/2005 | DiPoala | |
| 2005/0151886 | A1 | 7/2005 | Hirano | |
| 2006/0210278 | A1 * | 9/2006 | Cregg | G08C 23/04 398/107 |
| 2007/0139214 | A1 * | 6/2007 | Andersen | G08C 17/02 340/12.29 |
| 2008/0094203 | A1 * | 4/2008 | Kogan | G08B 25/10 340/506 |
| 2009/0051552 | A1 | 2/2009 | Chabanis et al. | |
| 2012/0249890 | A1 * | 10/2012 | Chardon | H04N 5/44 348/734 |

FOREIGN PATENT DOCUMENTS

WO 2011/151780 A1 12/2011

OTHER PUBLICATIONS

International Search Report & Written Opinion for PCT Patent Application PCT/US2014/031032, Jun. 18, 2014, 8 pages.
"Preventing False Alarms", Retrieved at <<http://www.stayout.com/customer-service/preventing-false-alarms>>, Retrieved Date: Dec. 17, 2012, pp. 4.

* cited by examiner

*Primary Examiner* — David Payne
*Assistant Examiner* — Omar S Ismail
(74) *Attorney, Agent, or Firm* — Gregg Wisdom; Judy Yee; Micky Minhas

(57) ABSTRACT

A code sequence relayed to an infrared blaster is monitored. If the code sequence approaches a violating sequence, the infrared blaster is controlled to emit infrared light with a corrected sequence that does not express the violating sequence. If the code sequence does not approach the violating sequence, the infrared blaster is controlled to emit infrared light with the code sequence.

16 Claims, 4 Drawing Sheets

CODE SEQUENCE CONTROL OF INFRARED BLASTER

BACKGROUND

Infrared light can be used to control devices such as televisions and media players. Remote controls are often used to emit the infrared light used to control such devices. However, some remote controls may not be configured to emit the correct infrared light sequences for controlling all devices. Furthermore, some remote controls may not be powerful enough to emit infrared light that can reach all devices in a particular environment.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

A code sequence relayed to an infrared blaster is monitored. If the code sequence approaches a violating sequence, the infrared blaster is controlled to emit infrared light with a corrected sequence that does not express the violating sequence. If the code sequence does not approach the violating sequence, the infrared blaster is controlled to emit infrared light with the code sequence.

DETAILED DESCRIPTION

The methods and systems described herein may be used to prevent an infrared (IR) blaster from emitting IR pulsed light in a sequence that has undesired effects on home-safety or other devices (e.g., smoke alarms and/or carbon monoxide detectors). As an example, pulsed light sequences that would cause a smoke alarm to sound may be prevented. The prevention of such undesired effects on the devices may be carried out by monitoring a code sequence controlling the IR blaster and predicting when the code sequence is likely to emit a violating sequence of pulsed IR light.

Figure 1:
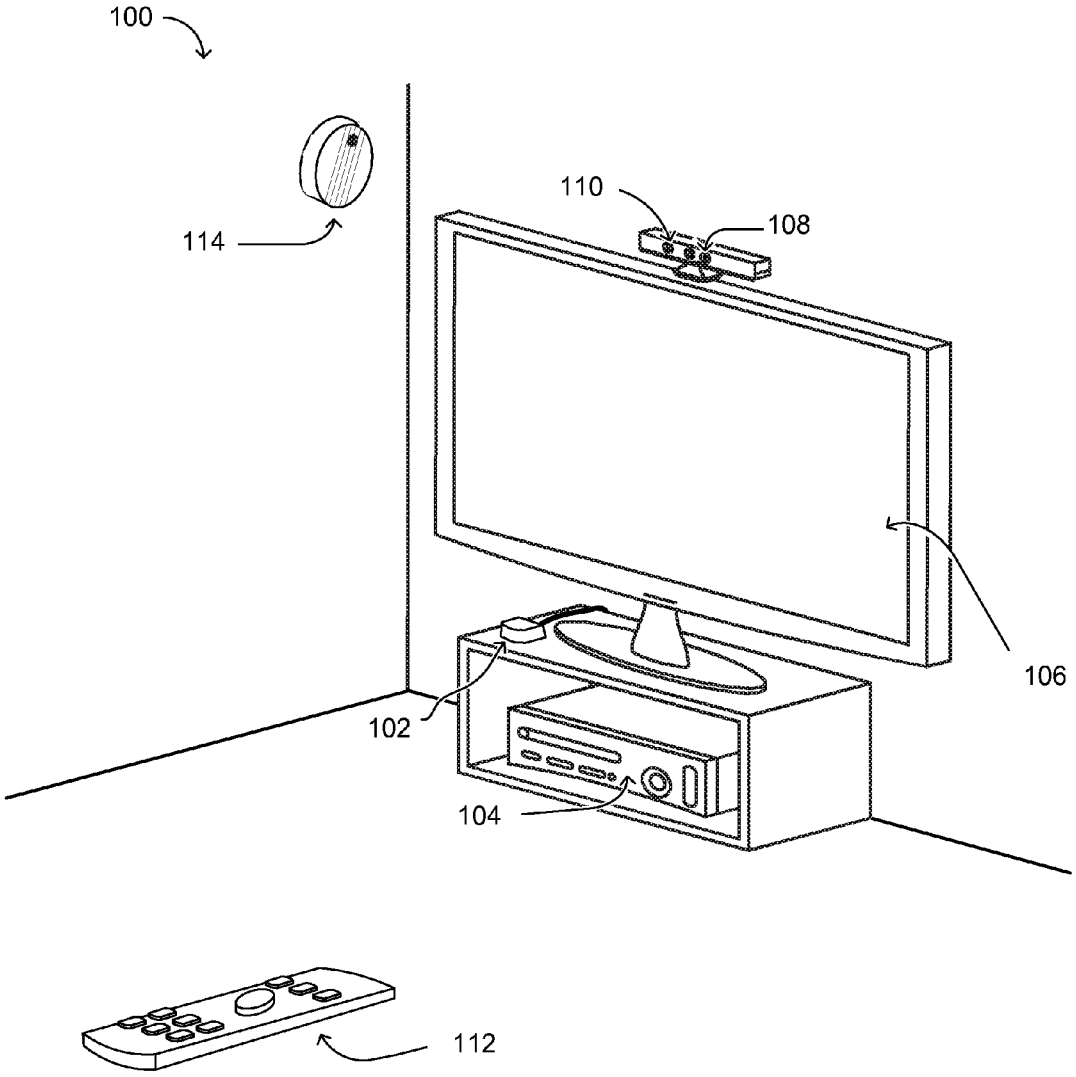
FIG. 1 shows an environment in which code sequences for infrared blasters are controlled in accordance with an embodiment of the present disclosure.

FIG. 1 shows an example environment 100 including an IR blaster 102 and various home electronic devices (e.g., game console 104 and television 106). FIG. 1 also shows a depth camera 108 that includes an illuminator 110 that may serve as an IR blaster. The environment also includes a remote control 112, which may not be programmed to natively control all available home electronic devices. For example, remote control 112 may not be programmed to natively control game console 104 and/or television 106. However, commands from remote control 112 may be translated into nonnative device commands for controlling nonnative home electronic devices, and such nonnative device commands may be output from the IR blaster and received by the various nonnative home electronic devices. In this way, a single remote control can be used to control a variety of different home electronic devices, such as game console 104 and television 106.

Environment 100 also includes a smoke alarm 114. The smoke alarm 114 may be configured to sound a test alarm when the smoke alarm receives an IR test signal. As such, it is desirable to prevent the IR blaster from unintentionally causing the smoke alarm to sound its test alarm.

Figure 2:
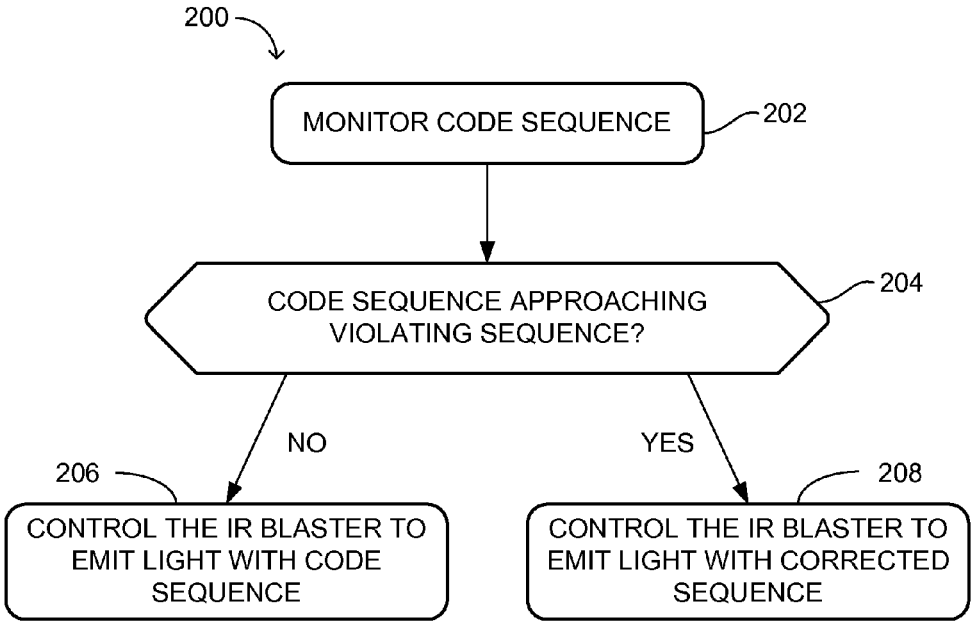
FIG. 2 shows an example method of relaying a code sequence for an IR blaster.

FIG. 2 shows an example method of relaying a code sequence for an IR blaster. At 202, method 200 includes monitoring the code sequence configured to control an IR blaster. As introduced above, an IR blaster may be configured to emit IR light according to a code sequence. In other words, the frequency, duty cycle, and/or other attributes of light emitted from the IR blaster may be based on the code sequence. The code sequence may be generated responsive to input from remote control 112. As non-limiting examples, the code sequence may be encoded in a drive signal configured to power the IR blaster, and/or the code sequence may be encoded in a control signal configured to control a driver of the IR blaster. Such control and/or drive signals may be monitored upstream of the blaster light that could emit a potentially violating sequence. Such monitoring can be performed by a test machine that is part of the IR blaster, a test machine that is a component of an electronic device (e.g., game console 104), or a test machine that is a standalone component configured to communicate with the IR blaster.

Figure 3A:
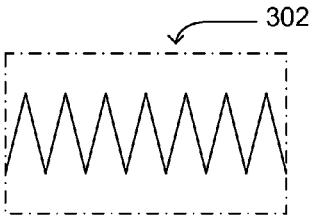
FIG. 3A shows a simplified visual representation of a violating sequence.

At 204, method 200 includes determining if the code sequence is approaching a violating sequence. As used herein, a violating sequence is a sequence that would likely cause a device (e.g., smoke alarm 114) to activate unintentionally. For example, FIG. 3A shows a simplified representation of an example violating sequence 302. In general, a violating sequence may be a digital or analog signal having one or more identifiable parameters and/or patterns used to activate a device (e.g., smoke alarm 114).

Digital and/or analog signals commonly used to control IR blasters may be tested in a controlled environment to determine which signals activate home-safety devices and are, therefore, violating sequences. Digital and/or analog code sequence characteristics (e.g., transmission frequency, bit rate, modulation, and maximum allowable interval length) and corresponding IR emissions for each digital and/or analog signal may be tested to determine which specific characteristics activate the devices. Identifiable parameters and/or patterns that cause activation of devices may then be recorded. Using this method, it is possible to determine digital and/or analog signal parameters and/or patterns that make-up violating sequences, such as violating sequence 302.

Figure 3B:
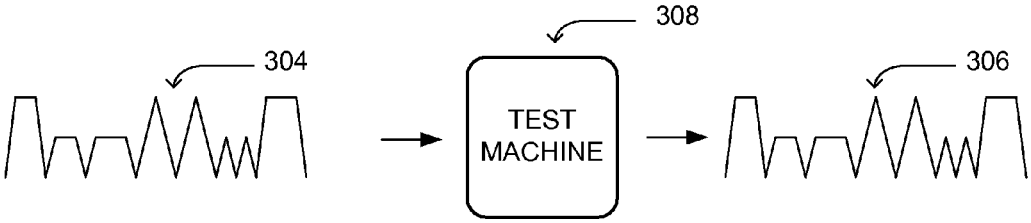
FIG. 3B shows a test machine relaying a code sequence that does not match the violating sequence of FIG. 3A.

FIG. 3B shows an example of an input code sequence 304 that does not match any known violating sequence (e.g., violating sequence 302). Because the input code sequence 304 does not match a violating sequence, there is little risk that an IR blaster expressing such a signal will unintentionally activate a device. As such, the IR blaster can emit IR light in accordance with an unmodified output code sequence 306 that matches the input code sequence 304. In other words, the light emitted from the IR blaster accurately reflects the input code sequence 304 supplied to test machine 308. Accordingly, at 206 of FIG. 2, method 200 includes controlling the IR blaster to emit IR light with the code sequence.

On the other hand, at 208 of FIG. 2, method 200 includes controlling the IR blaster to emit IR light with a corrected sequence that does not express the violating sequence. When the IR blaster is controlled with a corrected sequence, it is less likely to unintentionally activate a device.

Figure 3C:
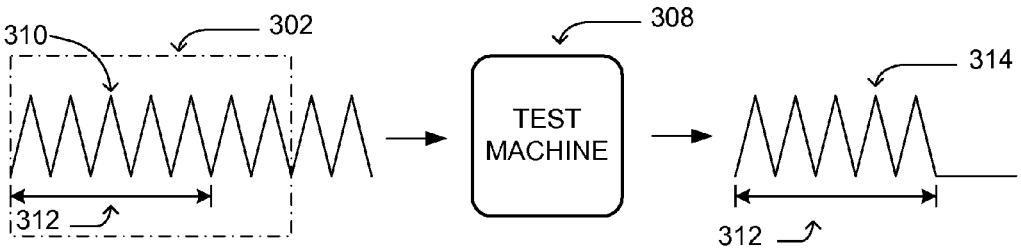
FIG. 3C shows a test machine truncating the violating sequence of FIG. 3A.
Figure 3D:
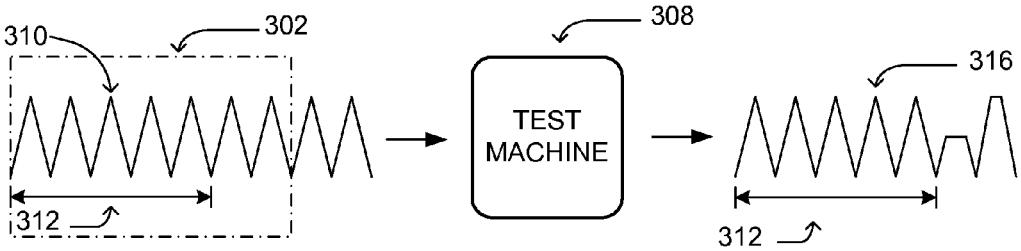
FIG. 3D shows a test machine altering the violating sequence of FIG. 3A.

FIGS. 3C and 3D show an example violating sequence 302. In other words, violating sequence 302 would likely cause a device to activate unintentionally if expressed without modification. However, such unintended activation of devices may be prevented by modifying violating sequence 302.

The process of modifying a violating sequence is performed by a test machine, such as test machine 308 of FIGS. 3C and 3D. In particular, the test machine monitors an input code sequence (such as input code sequence 310 of FIGS. 3C and 3D) and modifies it when the input code sequence approaches a violating sequence. In other words, if an input code sequence substantially matches the beginning portion of a violating sequence, the test machine predicts that the input code sequence, if left unaltered, would undesirably express the violating sequence.

Such predictions are made by the test machine using one or more predetermined threshold durations (e.g. threshold duration 312 of FIGS. 3C and 3D). The maximum allowable duration for expression of a violating sequence is characterized by the threshold duration. Additionally, the threshold duration length is a changeable parameter. If an input code sequence includes parameters and/or patterns that have been identified to cause unintentional activation of devices and those parameters and/or patterns are expressed for the threshold duration, the output code sequence may be modified relative to the input code sequence. Further, when the threshold duration is matched, the output code sequence is modified so as to express a corrected sequence (e.g., corrected sequence 314 of FIG. 3C or corrected sequence 316 of FIG. 3D) that does not express the violating sequence.

A corrected sequence does not activate a device unintentionally and may include any appropriate modification to a violating sequence. Corrected sequence 314 of FIG. 3C includes a truncation of violating sequence 302. The beginning of corrected sequence 314 includes the same parameters and/or patterns as violating sequence 302, but expression of those parameters and/or patterns does not exceed threshold duration 312 of violating sequence 302. Corrected sequence 316 of FIG. 3D includes an alteration of violating sequence 302. In particular, corrected sequence 316 includes an altered ending in addition to a beginning that substantially matches violating sequence 302, but does not exceed threshold duration 312. Truncations, alterations, and/or other modifications may be applied to an input code sequence in any suitable manner.

The length of threshold durations may vary based upon the parameters and/or patterns that make up the violating sequences. Further, corrected sequence length and characteristics may also vary. For example, some parameters and/or patterns of violating sequences may need shorter threshold durations and more exaggerated truncations and/or alterations of those parameters and/or patterns to ensure unintentional activation of devices is prevented. As nonlimiting examples, a sequence on for more than 2 seconds may avoid unintentional activation by using an interrupt duration of at least 1 second; a sequence on for less than 0.3 seconds, but repeating each 1 second for more than 15 seconds may avoid unintentional activation by using an interrupt duration of at least 2 seconds; and a sequence on for less than 1 second, but repeating less than each second, may avoid unintentional activation by using an interrupt duration of at least 2 seconds. The interrupt durations described in the above examples may be truncations or alterations.

Figure 4:
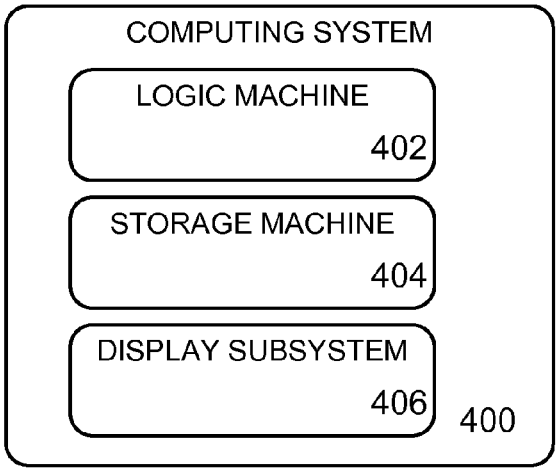
FIG. 4 schematically shows a computing system in accordance with an embodiment of the present disclosure.

In some embodiments, the methods and processes described above may be tied to a computing system of one or more computing devices. FIG. 4 schematically shows a non-limiting embodiment of a computing system 400 that can enact one or more of the methods and processes described above. As a nonlimiting example, computing system 400 may take the form of IR blaster 102 from FIG. 1, game console 104 from FIG. 1, or test machine 308 from FIGS. 3B, 3C, and FIG. 3D. Computing system 400 is shown in simplified form. Computing system 400 may also take the form of one or more personal computers, server computers, tablet computers, home-entertainment computers, network computing devices, gaming devices, mobile computing devices, mobile communication devices (e.g., smart phone), and/or other computing devices.

Computing system 400 includes a logic machine 402 and a storage machine 404. Computing system 400 may optionally include a display subsystem 406, such as television 106 of FIG. 1, input subsystem, such as remote control 112 of FIG. 1, communication subsystem, and/or other components not shown in FIG. 4.

Logic machine 402 may include one or more physical devices configured to execute instructions. For example, the logic machine may be configured to execute instructions that are part of one or more applications, services, programs, routines, libraries, objects, components, data structures, or other logical constructs. Such instructions may be implemented to perform a task, implement a data type, transform the state of one or more components, achieve a technical effect, or otherwise arrive at a desired result.

The logic machine may include one or more processors configured to execute software instructions. Additionally or alternatively, the logic machine may include one or more hardware or firmware logic machines configured to execute hardware or firmware instructions. Processors of the logic machine may be single-core or multi-core, and the instructions executed thereon may be configured for sequential, parallel, and/or distributed processing. Individual components of the logic machine optionally may be distributed among two or more separate devices, which may be remotely located and/or configured for coordinated processing. Aspects of the logic machine may be virtualized and executed by remotely accessible, networked computing devices configured in a cloud-computing configuration.

Storage machine 404 includes one or more physical devices configured to hold instructions executable by the logic machine to implement the methods and processes described herein. When such methods and processes are implemented, the state of storage machine 404 may be transformed—e.g., to hold different data.

Storage machine 404 may include removable and/or built-in devices. Storage machine 404 may include optical memory (e.g., CD, DVD, HD-DVD, Blu-Ray Disc, etc.), semiconductor memory (e.g., RAM, EPROM, EEPROM, etc.), and/or magnetic memory (e.g., hard-disk drive, floppy-disk drive, tape drive, MRAM, etc.), among others. Storage machine 404 may include volatile, nonvolatile, dynamic, static, read/write, read-only, random-access, sequential-access, location-addressable, file-addressable, and/or content-addressable devices.

It will be appreciated that storage machine 404 includes one or more physical devices. However, aspects of the instructions described herein alternatively may be propagated by a communication medium (e.g., an electromagnetic signal, an optical signal, etc.) that is not held by a physical device for a finite duration.

Aspects of logic machine 402 and storage machine 404 may be integrated together into one or more hardware-logic components. Such hardware-logic components may include field-programmable gate arrays (FPGAs), program- and application-specific integrated circuits (PASIC/ASICs), program- and application-specific standard products (PSSP/ASSPs), system-on-a-chip (SOC), and complex programmable logic devices (CPLDs), for example.

When included, display subsystem 406 may be used to present a visual representation of data held by storage machine 404. This visual representation may take the form of a graphical user interface (GUI). As the herein described methods and processes change the data held by the storage machine, and thus transform the state of the storage machine, the state of display subsystem 406 may likewise be transformed to visually represent changes in the underlying data. Display subsystem 406 may include one or more display devices utilizing virtually any type of technology. Such display devices may be combined with logic machine 402 and/or storage machine 404 in a shared enclosure, or such display devices may be peripheral display devices.

When included, the input subsystem may comprise or interface with one or more user-input devices such as a keyboard, mouse, touch screen, or game controller. In some embodiments, the input subsystem may comprise or interface with selected natural user input (NUI) componentry. Such componentry may be integrated or peripheral, and the transduction and/or processing of input actions may be handled on- or off-board. Example NUI componentry may include a microphone for speech and/or voice recognition; an IR, color, stereoscopic, and/or depth camera, such as depth camera 108 of FIG. 1, for machine vision and/or gesture recognition; a head tracker, eye tracker, accelerometer, and/or gyroscope for motion detection and/or intent recognition; as well as electric-field sensing componentry for assessing brain activity.

When included, the communication subsystem may be configured to communicatively couple computing system 400 with one or more other computing devices. Communication subsystem may include wired and/or wireless communication devices compatible with one or more different communication protocols. As non-limiting examples, the communication subsystem may be configured for communication via a wireless telephone network, or a wired or wireless local- or wide-area network. In some embodiments, the communication subsystem may allow computing system 400 to send and/or receive messages to and/or from other devices via a network such as the Internet.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A method of relaying a code sequence for an infrared blaster for relayed control of an intended device, the method comprising:

monitoring the code sequence;

if the code sequence approaches a violating sequence of an unintended device, control the infrared blaster to emit infrared light with a corrected sequence that does not express the violating sequence for the unintended device, the corrected sequence being an alteration of the violating sequence; and if the code sequence does not approach the violating sequence, control the infrared blaster to emit infrared light with the code sequence; wherein infrared light emitted with the violating sequence would activate the unintended device and infrared light emitted with the corrected sequence controls the intended device without activating the unintended device.

2. The method of claim 1, wherein the unintended device is a home-safety device.

3. The method of claim 2, wherein the home-safety device is a smoke alarm.

4. The method of claim 2, wherein the home-safety device is a carbon monoxide detector.

5. The method of claim 1, wherein the corrected sequence is a truncation of the violating sequence.

6. The method of claim 1, wherein the violating sequence is characterized by a threshold duration.

7. The method of claim 6, wherein the threshold duration is a changeable parameter.

8. The method of claim 1, wherein the code sequence is encoded in a drive signal configured to power the infrared blaster.

9. The method of claim 1, wherein the code sequence is encoded in a control signal configured to control a driver of the infrared blaster.

10. A computing system, comprising:

a logic machine;

a storage machine including instructions executable by the logic machine to:

monitor a code sequence configured to control an infrared blaster;

if the code sequence approaches a violating sequence, control the infrared blaster to emit infrared light with a corrected sequence that does not express the violating sequence, the corrected sequence being an alteration of the violating sequence;

if the code sequence does not approach the violating sequence, control the infrared blaster to emit light with the code sequence.

11. The computing system of claim 10, wherein the corrected sequence is a truncation of the violating sequence.

12. The computing system of claim 10, wherein the violating sequence is characterized by a threshold duration.

13. The computing system of claim 10, wherein the code sequence is encoded in a drive signal configured to power the infrared blaster.

14. The computing system of claim 10, wherein the code sequence is encoded in a control signal configured to control a driver of the infrared blaster.

15. A method of relaying a drive signal configured to power an infrared blaster, the method comprising:

monitoring a code sequence of the drive signal;

if the code sequence approaches a violating sequence configured to activate a home-safety device, drive the infrared blaster to emit infrared light with a corrected sequence that does not activate the home-safety device, the corrected sequence being an alteration of the violating sequence; and if the code sequence does not approach the violating sequence, control the infrared blaster to emit infrared light with the code sequence.

16. The method of claim 15, wherein the corrected sequence is a truncation of the violating sequence.

* * * * *